US010458643B1

(12) United States Patent
Liu et al.

(10) Patent No.: US 10,458,643 B1
(45) Date of Patent: Oct. 29, 2019

(54) BREATHING LIGHT ASSEMBLY

(71) Applicant: HON HAI PRECISION INDUSTRY CO., LTD., New Taipei (TW)

(72) Inventors: Cheng-Kuo Liu, New Taipei (TW); Chun-Kai Peng, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/204,117

(22) Filed: Nov. 29, 2018

(30) Foreign Application Priority Data

Jun. 14, 2018 (CN) ..... 2018 1 0615225

(51) Int. Cl.

| | |
|---|---|
| ***F21V 33/00*** | (2006.01) |
| ***F24F 3/16*** | (2006.01) |
| ***F24F 11/52*** | (2018.01) |
| ***F21Y 115/10*** | (2016.01) |
| ***F24F 110/72*** | (2018.01) |
| ***F24F 110/64*** | (2018.01) |
| ***F24F 110/70*** | (2018.01) |

(52) U.S. Cl.
CPC ..... *F21V 33/0088* (2013.01); *F24F 3/16* (2013.01); *F24F 11/52* (2018.01); *F21Y 2115/10* (2016.08); *F24F 2110/64* (2018.01); *F24F 2110/70* (2018.01); *F24F 2110/72* (2018.01)

(58) Field of Classification Search
CPC ..... F21V 33/0088; F24F 11/52; F24F 3/16; F24F 2110/64; F24F 2110/70; F24F 2110/72; F21Y 2115/10
See application file for complete search history.

(56) References Cited

U.S. PATENT DOCUMENTS

2013/0186279 A1* 7/2013 Dwyer ..... A62B 7/10 96/418
2016/0001108 A1* 1/2016 Zhou ..... A62B 18/02 128/863

FOREIGN PATENT DOCUMENTS

CN 206979853 U * 2/2018

* cited by examiner

*Primary Examiner* — Omer S Khan
(74) *Attorney, Agent, or Firm* — ScienBiziP, P.C.

(57) ABSTRACT

A breathing light assembly of an air purifier includes a front panel, a cover, a breathing light, a body cover, and a reflective strip. The cover includes a light transmission panel and a curved surface and is mounted to the front panel. The breathing light is mounted to the curved surface and faces the light transmission panel. The body cover cooperatively defines an optical channel with the cover. A surface of the body cover includes a light emitting zone within the optical channel. The light emitting zone faces the breathing light across the optical channel. Light emitted by the breathing light passes through the light transmission panel to the light emitting zone. The reflective strip is mounted on the light emitting zone and positioned at an end of the optical channel. The reflective strip reflects the light emitted by the breathing light.

8 Claims, 3 Drawing Sheets

BREATHING LIGHT ASSEMBLY

FIELD

The subject matter herein generally relates to breathing lights, and more particularly to a breathing light assembly of an air purifier.

BACKGROUND

Air purifiers that use lights to indicate an air quality generally use light emitting diode (LED) lights. However, when a color of the light emitted by the LED light is similar to a color of a housing of the air purifier, the light of the LED is not clear.

BRIEF DESCRIPTION OF THE DRAWINGS

Implementations of the present disclosure will now be described, by way of embodiments, with reference to the attached figures.

DETAILED DESCRIPTION

Figure 1:
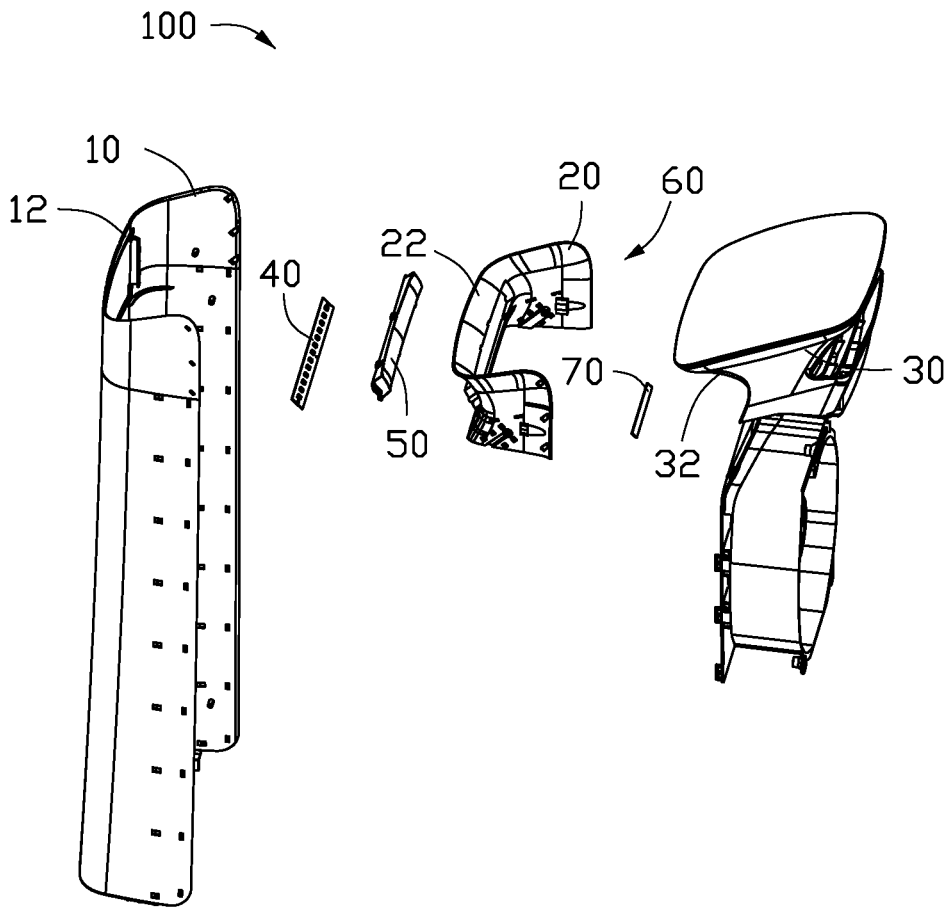
FIG. 1 is an exploded, isometric view of a breathing light assembly in accordance with an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 shows an embodiment of a breathing light assembly 100. In one embodiment, the breathing light assembly 100 is adapted for an air purifier. The breathing light assembly 100 includes a front panel 10, a cover 20, and a body cover 30. The front panel 10 and the cover 20 are coupled together and include a curved surface 22. A breathing light 40 is mounted to the curved surface 22. The breathing light 40 faces a light transmission panel 50 of the cover 20. The cover 20 and the body cover 30 cooperatively define an optical channel 60. The body cover 30 includes a light emitting zone 32 within the optical channel 60. The light emitting zone 32 faces the breathing light 40 across the optical channel 60. Light emitted by the breathing light 40 passes through the light transmission panel 50 to the light emitting zone 32. The light emitting zone 32 includes a reflective strip 70 positioned at an end of the optical channel 60. The reflective strip 70 reflects the light emitted by the breathing light 40. The breathing light 40 is mounted to the curved surface 22. The breathing light 40 is aligned with the light transmission panel 50. The curved surface 22 is formed on the cover 20, and a surface of the front panel 10 is concavely recessed to conform to a shape of the cover 20. The front panel 10 is coupled to the cover 20 by the recessed surface of the front panel 10 and the curved surface 22. The breathing light 40 is mounted in a space between the recessed surface of the front panel 10 and the curved surface 22.

Figure 2:
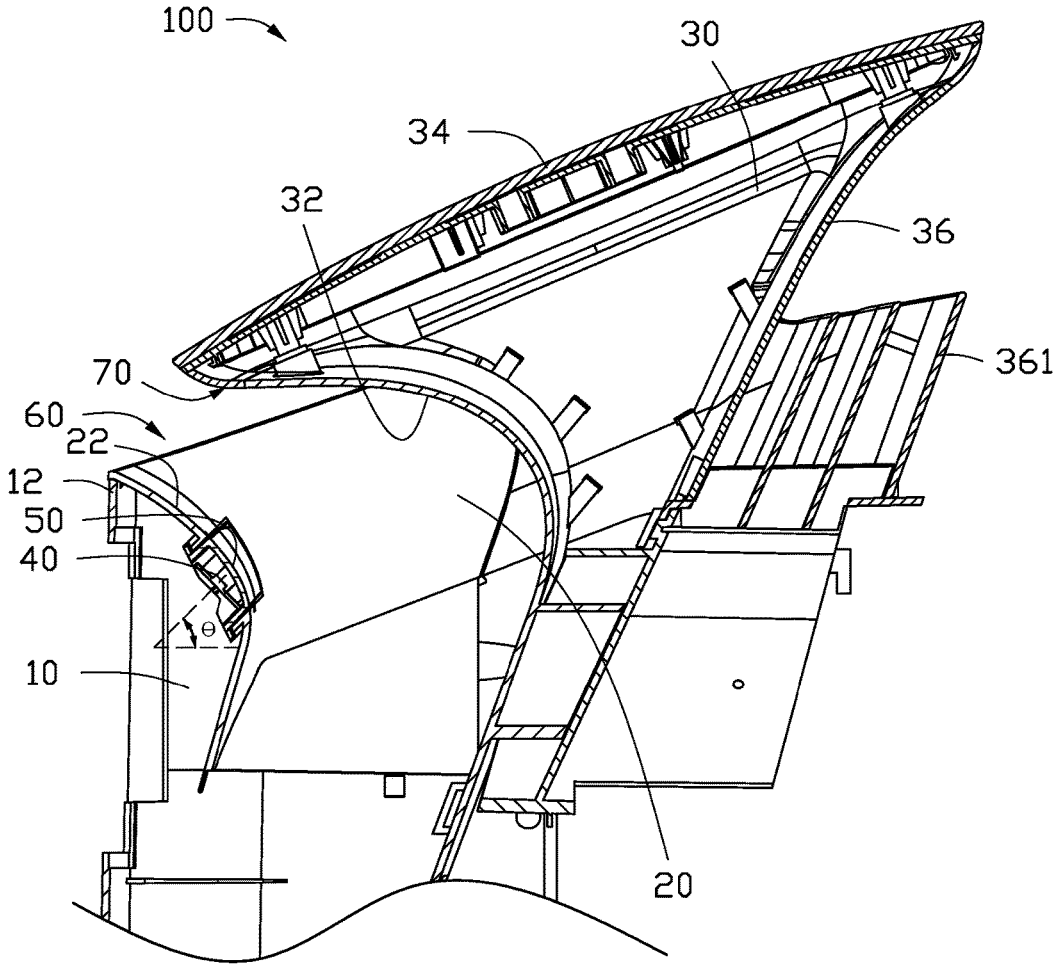
FIG. 2 is an assembled, cross-sectional view of the breathing light assembly in FIG. 1.

As shown in FIG. 2, the cover 20 is mounted to an upper portion of the front cover 10, and the light transmission plate 50 of the cover 20 is mounted to the curved surface 22. The breathing light 40 mounted on the curved surface 22 faces the light emitting zone 32 of the body cover 30 across the optical channel 60. The breathing light 40 emits light at an angle θ relative to a horizontal plane. The breathing light 40 emits light of different colors according to air quality. The light emitted by the breathing light 40 is projected along the angle θ to the light emitting zone 32. The light projected along the angle θ is projected evenly to the light emitting zone 32 to enhance a lighting effect. The breathing light 40 emitting the light along the angle θ enhances the lighting effect. In one embodiment, the angle θ between the breathing light 40 and the light emitting zone 32 is greater than 45 degrees. The light transmission panel 50 has a shape conforming to the shape of the curved surface 22 to spread out the light passing through the light transmission panel 50. In one embodiment, the light transmission panel 50 is milky white in color and made of acrylic. In addition to the light emitting along the angle θ to the light emitting zone 32, the light also passes through the curved shape of the light transmission panel 50 to spread out. The light emitting along the angle θ enhances clarity of the light by projecting more evenly, and the curved shape of the light transmission panel 50 enhances a field of view of the colored light on the light emitting zone 32.

As shown in FIG. 2, the body cover 30 further includes a touch portion 34 and a rear panel 36. The touch portion 34 is located at a top of the body cover 30. The rear panel 36 is located opposite to the light emitting zone 32. The body cover 30 includes the touch portion 34 at the top, and the light emitting zone 32 and the rear panel 36 are located below the touch portion 34. The touch portion 34 allows operating of the breathing light 40. The light emitting zone 32 is spaced from the cover 20 across the optical channel 60. A heat sink 361 is mounted to the rear panel 36. In one embodiment, the heat sink 361 is a radiating fin. Heat in the light emitting zone 32 generated by the light of the breathing light 40 is transmitted through the body cover 30 and dissipated by the radiating fin. The light emitting zone 32 forms a concaved curved surface. The concaved curved surface focuses the light emitted by the breathing light 40 before the light is projected out of the end of the optical channel 60. With the light emitting along the angle θ and the light transmission panel 50 projecting the light to the light emitting zone 32, the light projecting out of the end of the optical channel 60 is spread out evenly and focused clearly, so that the color of light emitted by the breathing light 40 can be clearly seen.

Figure 3:
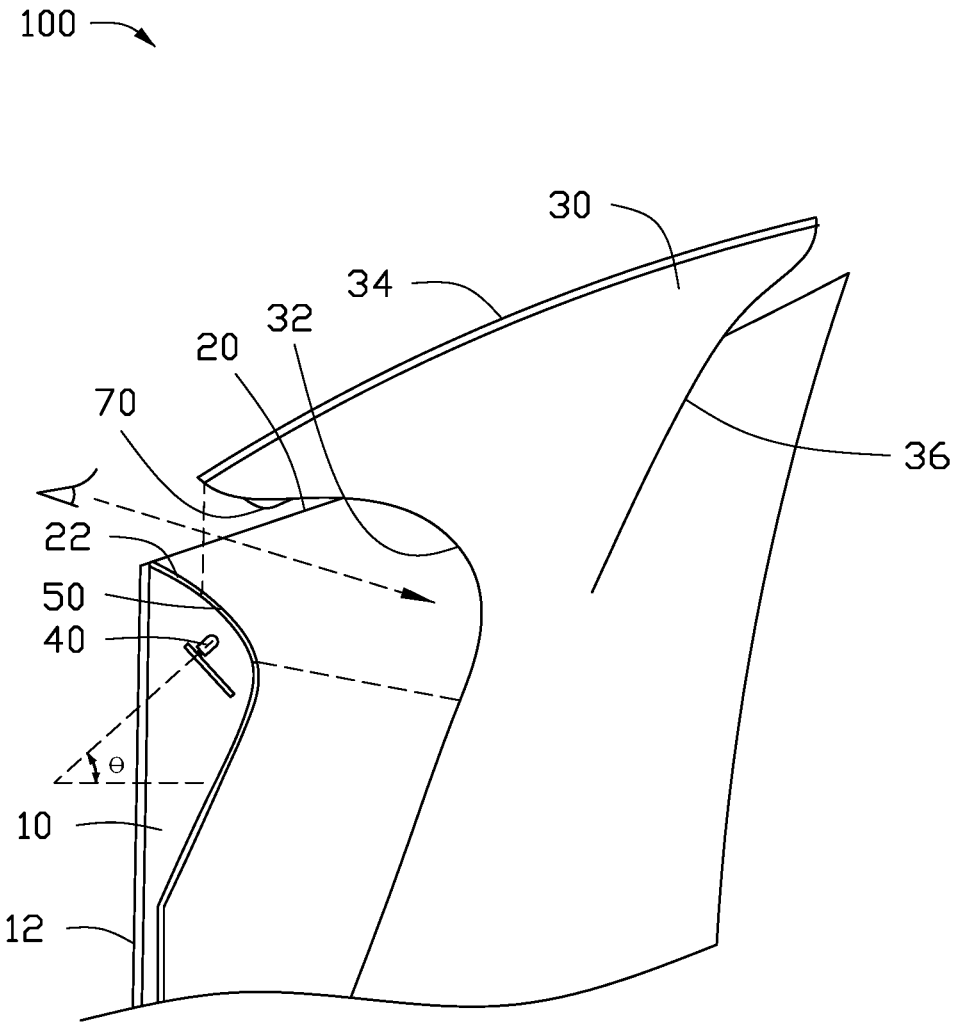
FIG. 3 is a diagram of the breathing light assembly in FIG. 2.

As shown in FIG. 3, in use, the breathing light 40 emits light having a color corresponding to the quality of the air. The light emitting zone 32 is adjacent to the end of the optical channel 60, so that the color of the light projected out of the optical channel 60 can be conveniently seen. The reflective strip 70 is mounted to a junction between the light emitting zone 32 and the top of the body cover 30, so that the reflective strip 70 is exposed out of the end of the optical channel 60 to reflect the projected light. Thus, a color of the body cover 30 is not infused with the color of light emitted by the breathing light 40.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A breathing light assembly of an air purifier, the breathing light assembly comprising:

a front panel;

a cover comprising a light transmission panel and a curved surface mounted to the front panel;

a breathing light mounted to the curved surface and facing the light transmission panel;

a body cover, the body and the cover cooperatively defining an optical channel; and a reflective strip; wherein:

a surface of the body cover comprises a light emitting zone within the optical channel, the light emitting zone facing the breathing light across the optical channel;

light emitted by the breathing light passes through the light transmission panel to the light emitting zone;

the reflective strip is mounted on the light emitting zone and positioned at an end of the optical channel; and the reflective strip reflects the light emitted by the breathing light;

wherein: the body cover comprises a touch portion and a rear panel; the touch portion is located at a top of the body cover; the rear panel is located opposite the light emitting zone; a heat sink is mounted to the rear panel;

wherein: the heat sink is a radiating fin; the body cover transmits heat in the light emitting zone and the radiating fin disperses heat from the light emitting zone.

2. The breathing light assembly of claim 1, wherein:

a surface of the front panel is concavely recessed to coupled to the cover;

the curved surface is formed on the cover;

the breathing light is mounted to the curved surface with a space between the surface of the front panel and the curved surface.

3. The breathing light assembly of claim 1, wherein:

the breathing light emits light at an angle relative to a horizontal plane;

the breathing light is adapted to emit light of different colors according to air quality;

the light emitted by the breathing light is projected along the angle to the light emitting zone.

4. The breathing light assembly of claim 1, wherein:

the cover is mounted to an upper part of the front panel;

the light transmission panel of the cover is mounted to the curved surface and faces the breathing light.

5. The breathing light assembly of claim 4, wherein:

the light transmission panel has a curved shape conforming to a shape of the curved surface;

the light emitted by the breathing light passes through a curvature of the light transmission panel.

6. The breathing light assembly of claim 5, wherein:

the light transmission panel is milky white in color and made of acrylic.

7. The breathing light assembly of claim 1, wherein:

the light emitting zone is located on a bottom portion of the body cover within the optical channel;

the light emitting zone is a concavely curved surface;

the concavely curved surface focuses the light emitted by the breathing light.

8. The breathing light assembly of claim 1, wherein:

the reflective strip is mounted to a junction of the light emitting zone and a top of the body cover at the end of the optical channel.

* * * * *